US005274877A

United States Patent [19]

Morad et al.

[11] Patent Number: 5,274,877

[45] Date of Patent: Jan. 4, 1994

[54] SEMI-AUTOMATIC MOP WRINGER

[75] Inventors: Fred I. Morad, Toluca Lake; Armond Asadurian, Glendale, both of Calif.

[73] Assignee: Worldwide Integrated Resources, Inc., Glendale, Calif.

[21] Appl. No.: 947,515

[22] Filed: Sep. 21, 1992

[51] Int. Cl.[5] ..... A47L 13/60

[52] U.S. Cl. ..... 15/262; 15/260

[58] Field of Search ..... 15/262, 261, 260

[56] References Cited

U.S. PATENT DOCUMENTS

| | | | |
|---|---|---|---|
| 660,201 | 10/1900 | Richardson | 15/261 |
| 885,607 | 4/1908 | Goehle | 15/261 |
| 1,922,981 | 8/1933 | Robertson | 15/262 |
| 2,417,416 | 3/1947 | Hutchins | 15/261 |
| 3,987,513 | 10/1976 | Gonzalez | 15/262 |

*Primary Examiner*—Chris K. Moore

*Attorney, Agent, or Firm*—Thomas I. Rozsa; Doug Chen

[57] ABSTRACT

The present invention is a unique semi-automatic mop wringer. The mop wringer comprises a hollow housing vertically movably supported on a supporting structure by a suspension mechanism. The housing is engaged with the supporting structure through a rack-and-gear mechanism, so that a downward motion of the housing can be transmitted into the rotation of crank members which in turn drive a wringer roller to squeeze the mop against a wringer plate mounted inside the housing. A user can use the present invention mop wringer to wring a mop by placing the mop inside the housing, holding the mop holder and applying a downward force. The downward motion of the housing causes the wringer roller to move in a circular path to squeeze the mop against the wringer plate. When the user withdraws the downward force, the housing moves back upwardly to allow the user to repeat the process. When the wringer roller has completed the squeezing motion, the wringer roller can automatically complete the remaining portion of the circular path.

25 Claims, 5 Drawing Sheets

FIG. 3
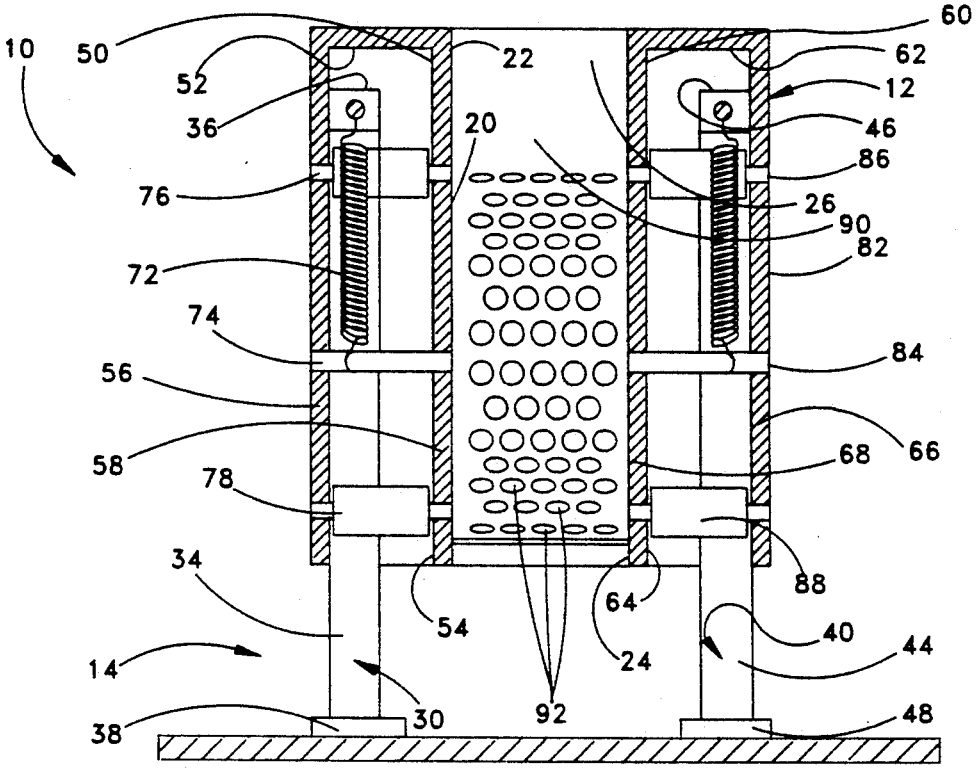
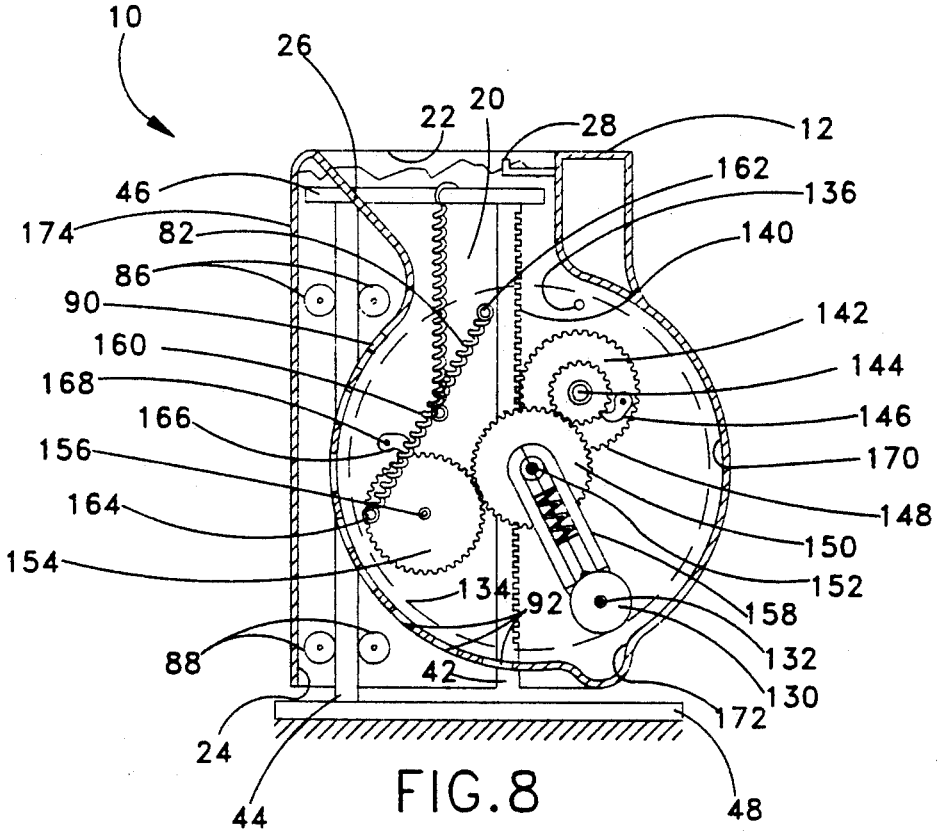
FIG. 8

SEMI-AUTOMATIC MOP WRINGER

BACKGROUND OF THE INVENTION

1. Field of the Invention

The present invention relates to the field of mop wringers. More particularly the present invention relates to the field of hand-operated mop wringers.

2. Description of the Prior Art

Mop wringers are used for wringing mops. The majority of mop wringers currently used in general households and ordinary businesses or institutions are hand-operated. A hand-operated mop wringer is usually mounted on top of a small water basket. A user can rinse a mop in the water basket and then drain the mop with the mop wringer.

A conventional hand-operated mop wringer typically includes a housing which can be mounted on top of the small water basket. The housing supports two wringer plates. The two wringer plates are oppositely disposed and spring biased in a spaced apart relationship. Each wringer plate has a plurality of small apertures for draining the water. The housing further supports a mechanism which can drive the two wringer plates moving towards each other.

The driving mechanism can be operated through a wringer handle. The wringer handle is pivotedly mounted at its lower end to the housing.

To drain a mop with the mop wringer, a user first places the mop between the two wringer plates, then pushes down the upper end of the wringer handle. Each time the upper end of the wringer handle is pressed, the two wringer plates will move towards each other and squeeze the mop. When the upper end of the wringer handle is released, the two wringer plates will separate and the wringer handle swings back. The user can then remove the mop from the wringer.

The conventional hand-operated mop wringer described above has many disadvantages. For example, a user of the conventional hand-operated mop wringer has to bend down to operate the wringer handle. This is because the conventional mop wringer requires a two-hand operation which often puts the user in an awkward position. The user must use one hand to hold the handle of the mop, and use the other hand to operate the handle of the wringer. The user usually needs to maintain the mop handle in a generally upright orientation with one hand, while bending down to completely push the wringer handle down with the other hand.

In addition, the effectiveness of the conventional hand-operated mop wringer depends on the strength of the user. To drain the mop more effectively, the user needs to push the wringer handle down harder. In other words, how hard the two wringer plates squeeze the mop depends on how hard the user pushes the wringer handle. A user with less strength often has to repeat the operation several times to drain the mop as desired. Furthermore, the user often needs to operate the wringer handle repeatedly to drain the mop as desired.

These drawbacks of the convention mop wringer are very undesirable for people with less physical strength, especially elderly people. Even for people with normal strength, the awkward and laborious operation of the mop wringer increases their fatigue very rapidly. Therefore, it is highly desirable to have a new type of mop wringer which can overcome the shortcomings of the prior are hand-operated mop wringers.

SUMMARY OF THE INVENTION

The present invention is a new semi-automatic mop wringer.

It is known that to use a prior art hand-operated mop wringer, a user often needs to hold the mop handle upright with one hand while pushing the wringer handle down with the other hand. Furthermore, the user often needs to repeatedly bend down and apply great strength to the wringer handle to fully drain the mop.

It has been discovered, according to the present invention, that the disadvantages of the prior art mop wringer result from the fact that the squeezing movement of the wringer plates is directly caused by the swing of the pivoted handle of the mop wringer. In order for the wringer plates to be moved closer, the wringer handle must be pushed further down. The displacement of the wringer plates is directly proportional to the swing angle of the wringer handle. Therefore, the user often needs to bend down to completely push the wringer handle down to make the wringer plates move closer.

It has also been discovered, according to the present invention, that the disadvantages of the prior art mop wringer result from the fact that the squeezing strength of the wringer plates is directly proportional to the strength applied on the wringer handle by the user. In order to squeeze the mop harder, greater strength must be applied to the wringer handle. Therefore, the user often needs to apply great strength to the wringer handle to drain the mop as desired.

It has been further discovered, according to the present invention, that when a mop is placed on the new mop wringer, the handle of the mop can be used by the user to activate the wringing function of the mop wringer. Since the mop handle is elongated and is kept upright, the user does not need to bend down to operate the mop wringer.

It has been additionally discovered, according to the present invention, that if the housing of the mop wringer is slidably suspended by springs on a supporting structure, then when mop is placed on the wringer housing, the user can make the wringer housing move downwardly by applying a downward force on the mop handle. Therefore, when the user does not apply the downward force on the mop handle, but instead merely holds the mop handle, the wringer housing will come back up by the force of the suspension springs.

It has also been discovered, according to the present invention, that if a pinion wheel is mounted on the wringer housing and geared with a rack structure of the supporting structure such that the slidable housing and supporting structure are engaged in a rack-and-pinion gearing relationship, then the vertical motion of the housing can be transmitted into rotational motion of the pinion, which can further act as the driving wheel of the wringing mechanism.

It has been further discovered, according to the present invention, that if the pinion wheel is engaged with a spur gear which is also mounted on the wringer housing and coupled with one end of a crank, and a wringer roller is provided at the other end of the crank, then the rotation of the pinion wheel will cause the wringer roller to move in a circular path. This means that the downward motion of the wringer housing will cause the wringer roller to move in the circular path.

It has been additionally discovered, according to the present invention, that if a semi-circular draining plate is mounted to the wringer housing and positioned to circumscribe the first half of the circular path of the wringer roller, then when a mop is placed inside the semi-circular draining plate and the wringer roller is driven by the crank and moves in the first half of its circular path, the wringer roller can squeeze the mop against the semi-circular draining plate to thereby wring the mop.

It has been also discovered, according to the present invention, that the rotational motion of the wringer cranks can be regulated by a spring-and-ratchet mechanism, such that when the wringer roller is squeezing the mop against the draining plate in the first half of its circular path, the wringer roller can stop and be balanced at any position, and when the wringer roller moves in the second half of its circular path, the roller is automatically driven back to its starting position.

It has been further discovered, according to the present invention, that if the pinion wheel and the spur gear are engaged through a one-way ratchet wheel mechanism, then the user can stop applying downward force to the wringer housing through the mop handle at any time to let the wringer housing move back upwardly, without causing the rotational motion of the spur gear, and when the wringer roller automatically moves back to its starting position in the second half of its circular path, the spur gear receives no resistance from the pinion wheel.

It is therefore a primary object of the present invention to provide a new semi-automatic mop wringer wherein the wringing action is not caused by the operation of a wringer handle. In other words, in the present invention new semi-automatic mop wringer, the wringer handle is eliminated.

It is also a principal object of the present invention to provide a new semi-automatic mop wringer wherein the wringing strength is automatically adjusted. This means that in the new semi-automatic mop wringer, how hard the mop is squeezed is completely independent of the strength of the user of the mop wringer.

It is a further object of the present invention to provide a new semi-automatic mop wringer, where the wringing action is activated by pushing down the mop handle. The elongated length and the upright orientation of the mop handle ensure that the user can operate the mop wringer in an upright position and does not have to bend down.

It is another object of the present invention to provide a new semi-automatic mop wringer, where the housing of the mop wringer is slidably suspended by springs on a supporting structure. When the mop is placed on the wringer housing, the user can make the wringer housing move downwardly by applying a downward force on the mop handle. When the user merely holds the mop handle without applying any downward force, the wringer housing will come back up by the force of the suspension springs.

It is also an object of the present invention to provide a new semi-automatic mop wringer, where a pinion wheel is mounted on the wringer housing and geared with a rack structure of the supporting structure, so that the slidable housing and supporting structure are engaged in a rack-and-pinion gearing relationship. When the wringer housing is pushed down by the user through the mop handle, the downward motion of the wringer housing is transmitted into the rotational motion of the pinion for driving the wringing mechanism of the mop wringer.

It is a further object of the present invention to provide a new semi-automatic mop wringer, where a spur gear is also pivotally mounted on the wringer housing and engaged with the pinion wheel, and a crank is coupled at its one end with the spur gear, so that the rotational motion of the pinion wheel will drive a wringer roller attached at the other end of the crank to move in a circular path. Since the rotational motion of the pinion wheel is caused by the downward motion of the wringer housing, a user can cause the movement of the wringer roller by placing a mop on the wringer housing and pushing down the mop handle.

It is an additional object of the present invention to provide a new semi-automatic mop wringer, where a semi-circular draining plate is mounted to the wringer housing and positioned to envelop the first half of the circular path of the wringer roller, so that when the wringer roller is driven by the crank and moves in the first half of its circular path and a mop is placed inside the semi-circular draining plate, the mop is squeezed by the wringer roller against the semi-circular draining plate.

It is also an object of the present invention to provide a new semi-automatic mop wringer, where the rotational motion of the wringer cranks is governed by a spring-and-ratchet mechanism. When the wringer roller is moving in the first half of its circular path and squeezing the mop against the draining plate, the wringer roller can stop at any position and remain balanced at that position. When the wringer roller is moving in the second half of its circular path, it is automatically and rapidly driven back to its starting position.

It is a further object of the present invention to provide a new semi-automatic mop wringer, where the pinion wheel and the spur gear are engaged through a one-way ratchet wheel mechanism, so that the user can stop applying downward force to the wringer housing through the mop handle at any time to let the wringer housing move back upwardly, without causing the rotational motion of the spur gear. In addition, when the wringer roller automatically swings back to its starting position in the second half of its circular path, no resistance is applied to the spur gear by the pinion wheel.

It is an additional object of the present invention to provide a new semi-automatic mop wringer which can be used in conjunction with a regular water basket.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 3 is a simplified cross-sectional end view of the present invention semi-automatic mop wringer showing its basic structure.

FIG. 8 is another partial cross-sectional side view of the present invention semi-automatic mop wringer showing the wringer roller at a return position.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
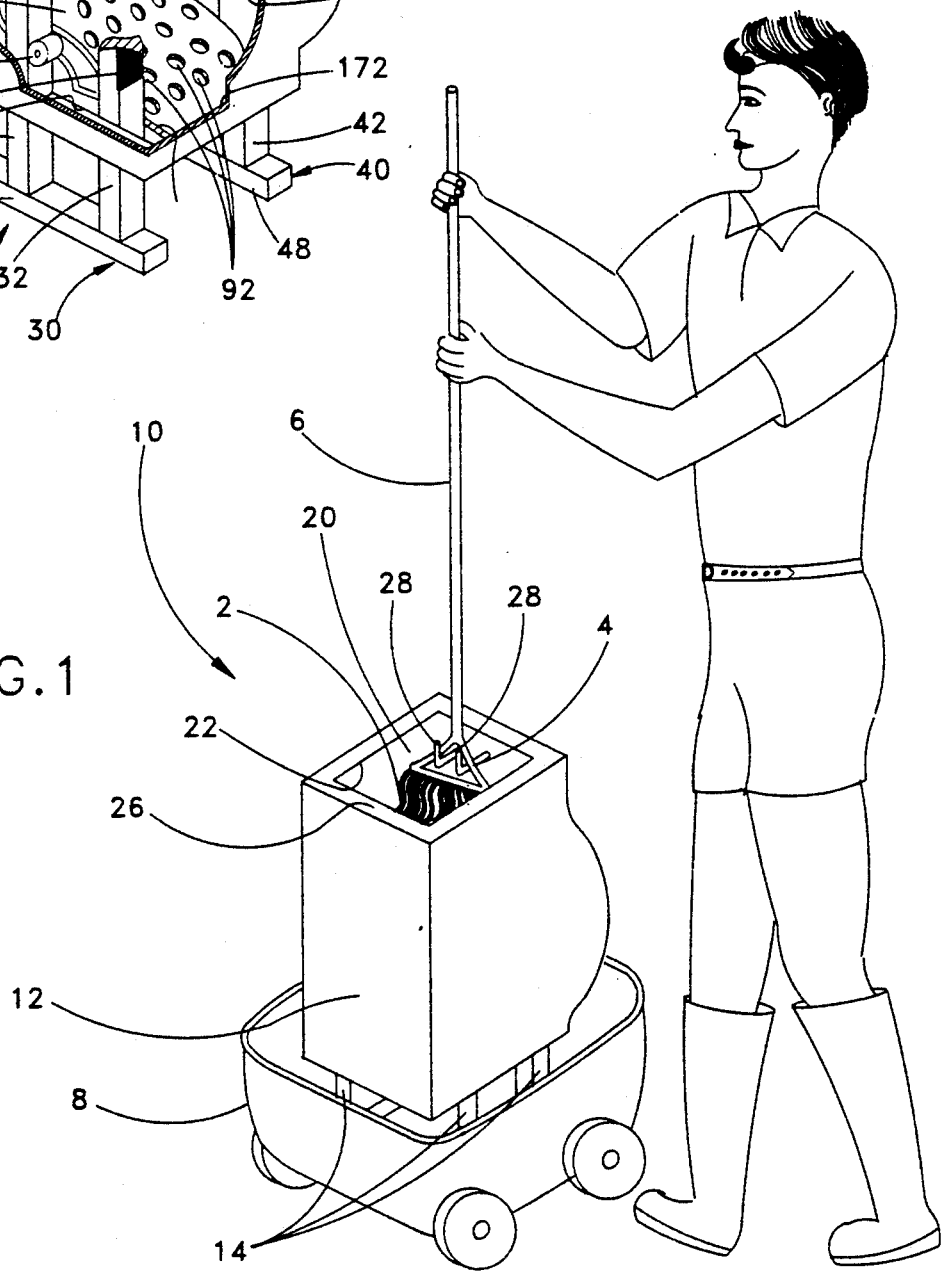
FIG. 1 is a perspective view of a user using the present invention semi-automatic mop wringer to wring a mop.

Referring to FIG. 1, there is shown a perspective view of a user using the present invention semi-automatic mop wringer 10. Typically a mop 2 is retained by a mop holder 4, upon which a handle 6 is attached. Mop wringer 10 can be used in conjunction with a conventional water basket 8. Alternatively, mop wringer 10 may be provided with its own water basket.

Mop wringer 10 has a box shaped housing 12 which is suspended on a supporting structure 14. Housing 12 has a main central compartment 20, which is a hollow interior compartment. Main compartment 20 has a top entrance 22 and an open bottom 24 (not shown in FIG. 1 but shown in FIGS. 3 and 5). An inclined surface 26 is provided at top entrance 22 for guiding mop 2. A pair of hooks 28 are also provided at a location proximal to top entrance 22 for adapting mop holder 4. The function of hooks 28 is to allow the user to rest mop holder 4 thereupon, so the user can apply a downward force on housing 12. Hooks 28 may be replaced by other suitable means for different shaped mop holders 4.

Figure 2:
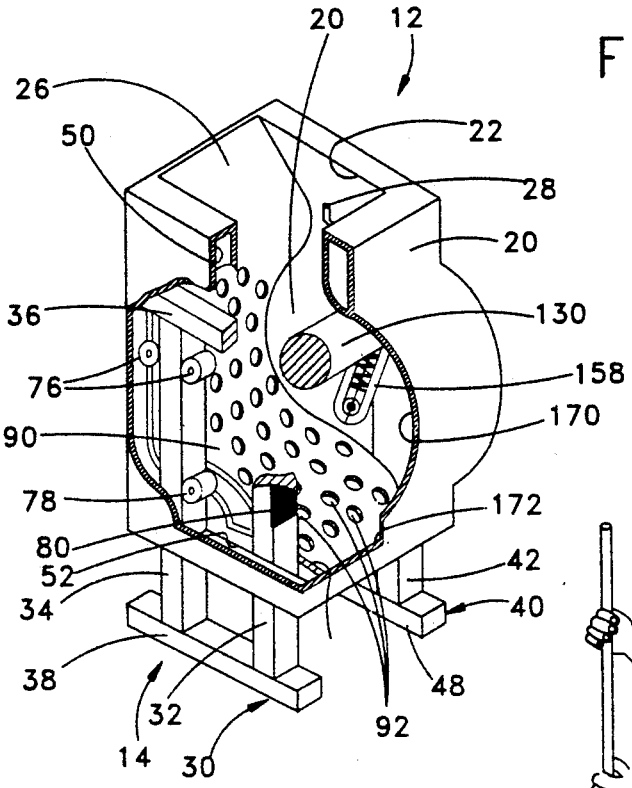
FIG. 2 is a partial cross-sectional perspective view of the present invention semi-automatic mop wringer.

Referring to FIG. 2, there is shown a partial cross-sectional perspective view of the present invention semi-automatic mop wringer 10. Housing 12 is supported by supporting structure 14. Supporting structure 14 includes two symmetrical upright stands 30 and 40, which may be coupled or independent from each other. Stand 30 includes a vertical rack 32 and a vertical rail 34. The upper ends of rack 32 and rail 34 are coupled by a horizontal beam 36, and the lower ends of rack 32 and rail 34 are coupled by a horizontal base 38. Similarly, stand 40 includes a vertical rack 42 and a vertical rail 44 (not shown in FIG. 1 but shown in FIGS. 6 and 7). The upper ends of rack 42 and rail 44 are coupled by a horizontal beam 46 (not shown in FIG. 1 but shown in FIGS. 6 and 7), and the lower ends of rack 42 and rail 44 are coupled by a horizontal base 48.

Referring to FIG. 3, there is shown a simplified cross-sectional end view of the present invention semi-automatic mop wringer 10. In addition to main compartment 20, housing 12 has two symmetrical side hollow compartments 50 and 60. Side compartment 50 has a closed top 52, a bottom opening 54, an outer sidewall 56 and an inner sidewall 58. Similarly, side compartment 60 also has a closed top 62, a bottom opening 64, an outer sidewall 66 and an inner sidewall 68. Side compartments 50 and 60 of housing 12 provide enclosures for stands 30 and 40 of supporting structure 14. Stand 30 extends into side compartment 50 through bottom opening 54 and is located against outer sidewall 56, and stand 40 extends into side chamber 60 through bottom opening 64 and is located against outer sidewall 66. In this arrangement, housing 12 is slidably engaged with stands 30 and 40 and can move up and down.

Furthermore, a suspension mechanism is provided in each side compartment. For example, in side compartment 50, a coil spring 72 can be attached between horizontal beam 36 and a pin 74 which is mounted to sidewalls 56 and 58. Similarly, in side compartment 60, a coil spring 82 can be attached between horizontal beam 46 and a pin 84 which is mounted to sidewalls 66 and 68. When a downward force is applied to housing 12, it moves downwardly and stretches springs 72 and 82. The stretched springs 72 and 82 will then exert an upward force on housing 12. Therefore, as soon as the downward force on housing 12 is withdrawn, housing 12 will automatically move upwardly and back to its balanced position. Of course the number of springs, the type of springs, and the location and manner of spring attachment, etc., can vary. For example, each side compartment may have two coil springs. Alternatively, leaf springs or spring plates may be used. The strength of the spring members are selected to properly balance the overall weight of housing 10 and the mechanical components mounted to housing 10.

The suspension mechanisms also include rollers for aligning the vertical movement of housing 12. For example, two pairs of rollers may be rotatably mounted between sidewalls 56 and 58 of side compartment 50, and two pairs of rollers may be mounted between sidewalls 66 and 68 of side compartment 60. The first pair of rollers 76 (only one is shown in FIG. 3 but both are shown in FIG. 2) are located in the upper portion of side compartment 50 and clamp an upper portion of vertical rail 34 in between (in a manner shown in FIG. 2). The second pair of rollers 78 (again, only one is shown in FIG. 3) are located in the lower portion of side compartment 50 and clamp a lower portion of vertical rail 34 in between in a manner similar to the first pair of rollers 76. Similarly, the first pair of rollers 86 (only one is shown in FIG. 3 but both are shown in FIG. 8) are located in the upper portion of side compartment 60 and clamp an upper portion of vertical rail 44 in between, and the second pair of rollers 88 (only one is shown in FIG. 3 but both are shown in FIG. 8) are located in the lower portion of side compartment 60 and clamp a lower portion of vertical rail 44 in between. The function of these rollers is to make sure that housing 12 moves vertically, and to reduce the resistance between housing 12 and supporting structure 14.

Therefore, it is one of the unique features of the present invention mop wringer 10 that its housing 12 is supported by its supporting structure 14 with spring suspension.

Referring to FIGS. 2 and 3 together, there is shown at 90 a curved wringer plate which is mounted inside main compartment 20, between inner sidewall 58 of side compartment 50 and inner sidewall 68 of side compartment 60. The top portion of wringer plate 90 constitutes inclined surface 26 at the top entrance 22 of main compartment 20. The main portion of wringer plate 90 has a semi-circular configuration and a multiplicity of apertures 92. When mop 2 is placed inside main compartment 20, apertures 92 will allow water to drain through and flow out from open bottom 24 of main compartment 20.

Figure 4:
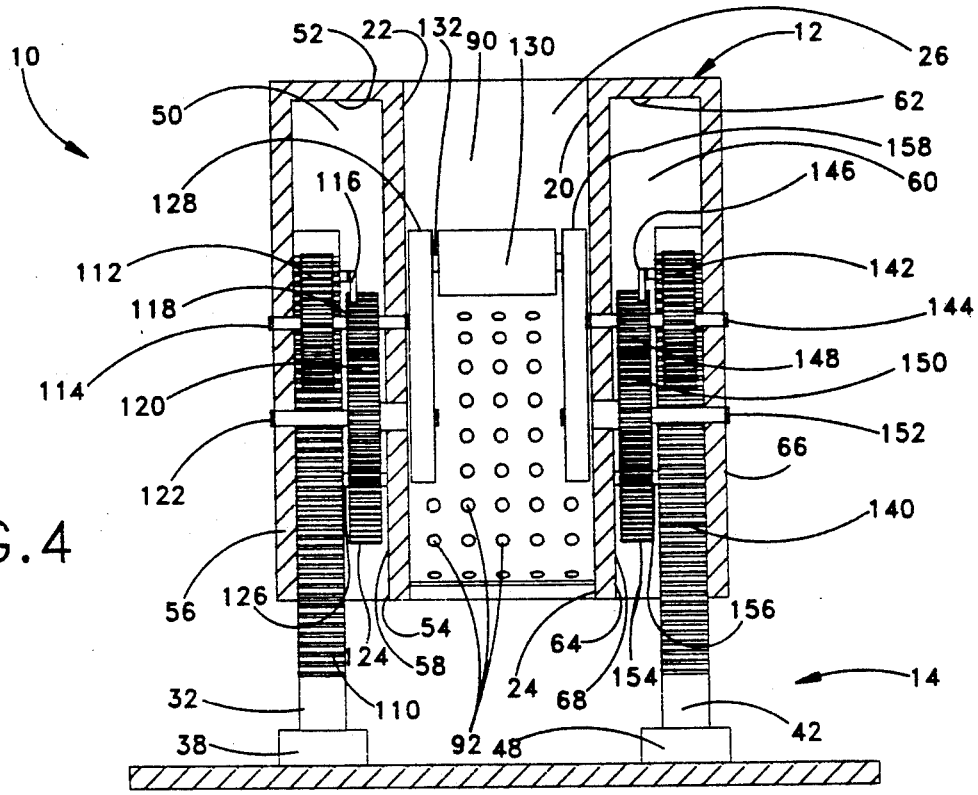
FIG. 4 is also a cross-sectional end view of the present invention semi-automatic mop wringer showing its gearing system and one position of the wringer roller.

Referring to FIG. 4, there is shown the gearing system of the present invention semi-automatic mop wringer 10. Preferably, the gearing system of mop wringer 10 is completely enclosed in side compartments 50 and 60, and the respective gear arrangements in side compartments 50 and 60 are completely symmetrical.

In side compartment 50, teeth 110 are provided along an upper portion of vertical rack 32 of stand 30. A pinion 112 is engaged with teeth 110 of rack 32 and rotatably mounted on an axle 114, which is in turn mounted on sidewalls 56 and 58 of side compartment 50. Axle 114 may have ball bearings or other suitable means for reducing rotational resistance. Pinion 112 and rack 32 is therefore engaged in a rack-and-pinion gearing relationship. When housing 12 moves downwardly, its translational motion is transmitted through rack 32 to the rotational motion of pinion 112.

It is another unique feature of the present invention mop wringer 10 that the vertical translational motion of housing 10 is transmitted into the rotational motion of spur gear 120 through a rack-and-pinion gearing arrangement.

A pawl 116 is mounted on one side of pinion wheel 112 and engageable with a small ratchet wheel 118, which is also rotatably mounted on axle 114. Small ratchet wheel 118 in turn is meshed with a spur gear 120, which is rotatably mounted on another axle 122. Axle 122 again may have ball bearings or other suitable means for reducing rotational resistance. Pawl 116 and small ratchet wheel 118 engage in a pawl-and-ratchet relationship to transmit the rotational motion of pinion 112 to spur gear 120 in a "one-way" manner. That is, the rotational motion of pinion 112 is transmitted to spur gear 120 only when housing 12 moves downwardly. When housing 12 moves back upwardly, pawl 116 simply slides on small ratchet wheel 118, and the rotational motion of pinion 112 is not transmitted to spur gear 120. Therefore the rotation of spur gear 120 is isolated from the upward vertical translational movement of housing 12.

It is also a unique feature of the present invention mop wringer 10 that through the use of a one-way pawl-and-ratchet arrangement, only the downward translational movement of housing 12 is transmitted to the rotational motion of spur gear 120. When housing 12 is pulled upwardly by springs 72 and 82, its upward translational motion is not transmitted to the rotational motion of spur gear 120.

Spur gear 120 is meshed with a spring biased large ratchet wheel 124. Spring biased large ratchet wheel 124 is rotatably mounted on an axle 126, which is in turn journaled only in sidewall 58 of side compartment 50. The function of spring biased large ratchet wheel 124 will be described later.

Spur gear 120 is further coupled with a crank 128 for driving a wringer roller 130 in a circular path. Roller 130 is rotatably mounted on an axle 132, which is supported at one end by crank 128.

In side compartment 60, the mechanical arrangement is identical to the above described arrangement in side compartment 50. Teeth 140 are provided along an upper portion of vertical rack 42 of stand 40. A pinion 142 is engaged with teeth 140 of rack 42 and rotatably mounted on an axle 144, which is in turn mounted on sidewalls 66 and 68 of side compartment 60. Axle 144 may have ball bearings or other suitable means for reducing rotational resistance. Pinion 142 and rack 42 is therefore also engaged in a rack-and-pinion gearing relationship for transmitting the downward vertical motion of housing 12 to the rotational motion of pinion 142.

A pawl 146 is mounted on one side of pinion wheel 142 and engageable with a small ratchet wheel 148, which is also rotatably mounted on axle 144. Small ratchet wheel 148 in turn is meshed with a spur gear 150, which is rotatably mounted on another axle 152. Axle 152 again may have ball bearings or other suitable means for reducing rotational resistance. Pawl 146 and small ratchet wheel 148 engage in a pawl-and-ratchet relationship to transmit the rotational motion of pinion 142 to spur gear 150 in a "one-way" manner, so that the rotational motion of pinion 112 is transmitted to spur gear 150 only when housing 12 moves downwardly. When housing 12 moves back upwardly, pawl 146 simply slides on small ratchet wheel 148, and the rotational motion of pinion 142 is not transmitted to spur gear 150.

Spur gear 150 is meshed with a spring biased large ratchet wheel 154. Spring biased large ratchet wheel 154 is rotatably mounted on an axle 156, which is in turn journaled only in sidewall 68 of side compartment 60. The function of spring biased large ratchet wheel 154 is similar to that of spring biased large ratchet wheel 124 in side compartment 50, and will be described later. Spur gear 150 is further coupled with a crank 158, which supports the other end of roller axle 132.

Figure 5:
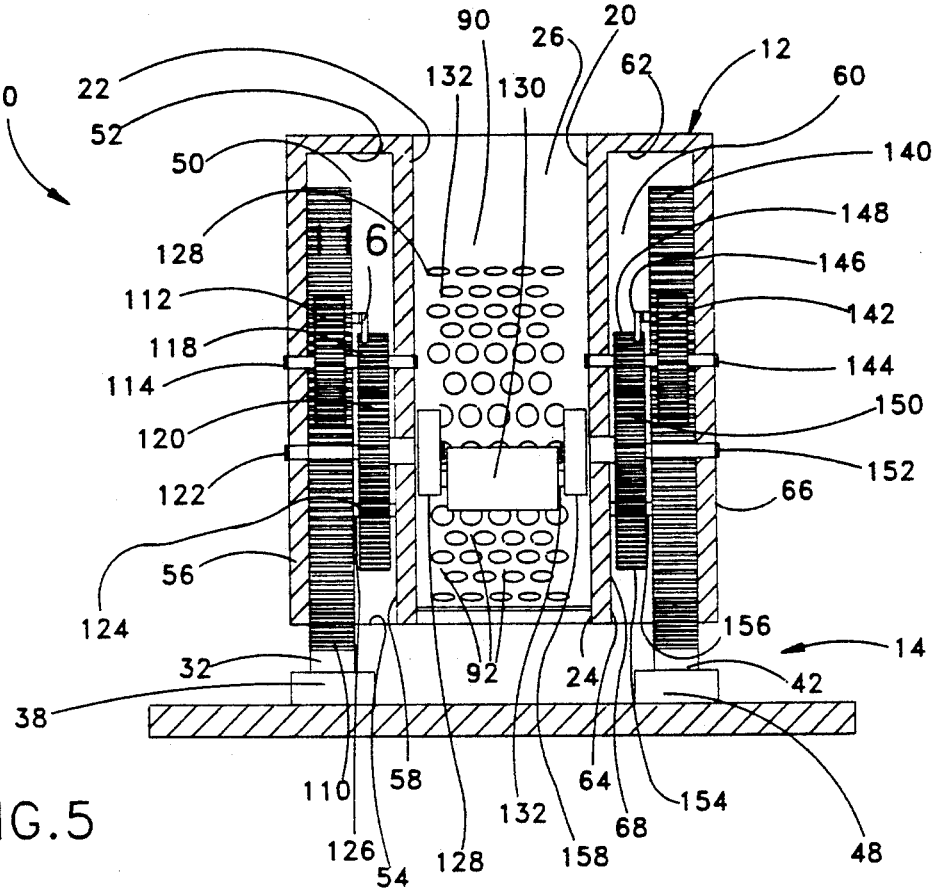
FIG. 5 is another cross-sectional end view of the present invention semi-automatic mop wringer showing another position of the wringer roller.

Referring to FIG. 5, there is shown another cross-sectional end view of the present invention semi-automatic mop wringer 10 showing another position of wringer roller 130. When housing 12 is pushed to move downwardly, pinion wheels 112 and 142 rotate on rack 32 and 42 respectively. The rotational motion of pinion wheels 112 and 142 are transmitted to spur gears 120 and 150 through small ratchet wheels 118 and 148 respectively. Spur gears 120 and 150 together drive roller 130 respectively through cranks 128 and 158.

Figure 6:
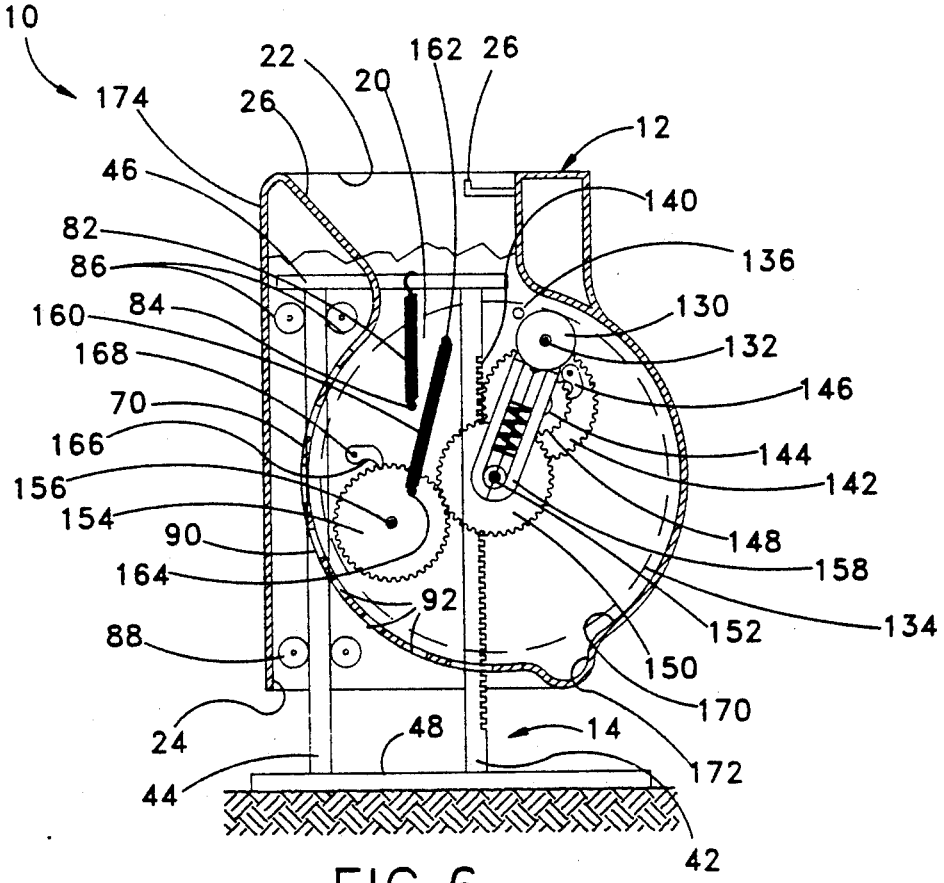
FIG. 6 is a partial cross-sectional side view of the present invention semi-automatic mop wringer showing the wringer roller at its starting position.

Referring to FIG. 6, there is shown a partial cross-sectional side view of the present invention semi-automatic mop wringer 10, showing wringer roller 130 at its starting position.

Shown in FIG. 6, housing 12 is spring suspended and supported by supporting structure 14. Suspension spring 82 is stretched between horizonal beam 46 of vertical stand 40 at one end and pin 84 at the other end. In addition, two pairs of rollers 86 and 88 are used to regulate the vertical movement of housing 12 and reduce the resistance between housing 12 and supporting structure 14.

Further shown in FIG. 6, roller 130 can move in a circular path indicated by dotted circle 134. The first half of circular path 134 is substantially circumscribed by wringer plate 90. In the second half of circular path 134, roller 130 moves back to its starting position. A pair of small pins may be mounted through the sidewalls of side compartments 50 and 60 for stopping roller 130 at its starting position. One such small stopping pin 136 is shown in FIG. 6.

Additionally shown in FIG. 6, the rotation of large ratchet wheel 154 is biased by a coil spring 160 located in side compartment 60. One end of spring 160 is attached to a pin 162 which is mounted between sidewalls 66 and 68 of side compartment 60, and the other end of spring 160 is mounted to a pin 164 located near the rim of larger ratchet wheel 154. The rotation of large ratchet wheel 154 is further regulated by a pawl 166 also located within side compartment 60 and mounted to a pin 168, which is again mounted between sidewalls 66 and 68 of side compartment 60. The function of pawl 166 is to prevent large ratchet wheel 154 from rotating in the counter-clockwise direction (hereafter the "C− direction"). Therefore, larger ratchet wheel 154 can only rotate in the clockwise direction (hereafter the "C+ direction").

Figure 7:
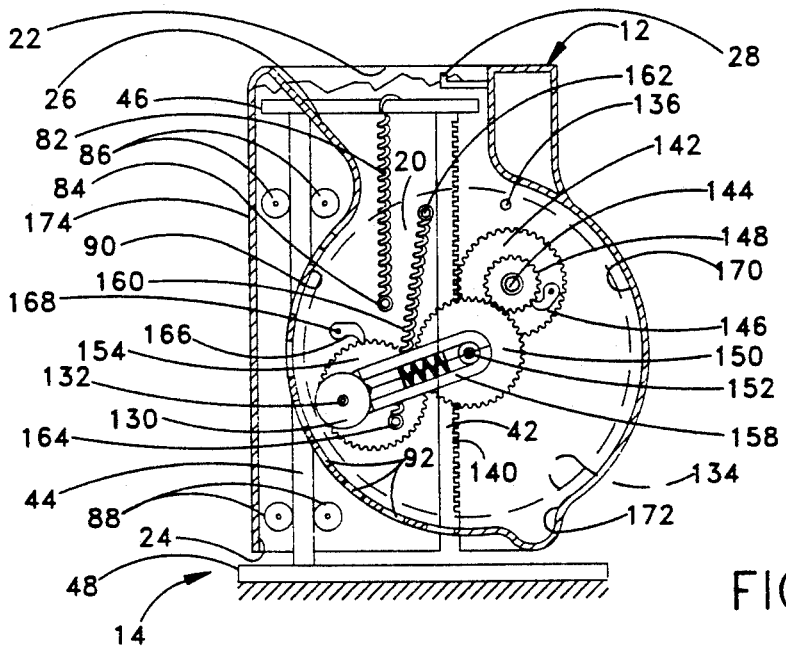
FIG. 7 is also a partial cross-sectional side view of the present invention semi-automatic mop wringer showing the wringer roller at a wringing position.

Referring to FIG. 7, there is also shown a partial cross-sectional side view of the present invention semi-automatic mop wringer 10, showing wringer roller 130 at a wringing position in the first half of its circular path 134. When housing 12 is pushed to move downwardly, pinion wheel 142 will rotate in the C+ direction, which in turn causes spur gear 150 to rotate in the C− direction through pawl 146 and small ratchet wheel 148. Spur gear 150 will then drive crank 158 to rotate in the C− direction, which in turn causes roller 130 to move in the first half of circular path 134.

When spur gear 150 rotates in the C− direction, it causes large ratchet wheel 154 to rotate in the C+ direction, which in turn further stretches spring 160. Spring 160 applies to large ratchet wheel 154 a torque in the C− direction. However, since large ratchet wheel 154 is engaged with pawl 166, it cannot rotate in the C− direction. Therefore spring 160 acts to resist the movement of roller 130 in the first half of circular path 134.

It is a further unique feature of the present invention mop wringer 10 that because of the function of spring 160, roller 130 can be balanced almost anywhere along the first half of its circular path 134. The tension of spring 160 is so selected such that: (a) if the initial downward impact on housing 12 is strong, then roller 130 will travel all the way through the first half of its circular path 134; (b) if the initial downward impact on housing 12 is moderate, then roller 130 will travel about halfway through the first half of its circular path 134; and (c) if the initial downward impact on housing 12 is weak, then roller 130 will only travel a small portion of the first half of its circular path 134.

In the last two instances where roller 130 is balanced mid-way through the first half of its circular path, housing 12 is caused to move back upwardly by suspension spring 82. When housing 12 moves back upwardly, pinion 142 rotates on rack 42 in the C− direction. However, the rotation of pinion 142 will not be transmitted to spur gear 150 because of the one-way engagement of pawl 146 and small ratchet wheel 148. Therefore, the balancing position of roller 130 will not be disturbed when housing 12 moves upwardly.

It is another unique feature of the present invention mop wringer 10 that the wringer circle can be completed in either "one shut" or several intermittent actions. This is ideal for users with weak strength. Such a user can apply a little downward force on housing 12 several pushes, one at a time. The weak force will cause housing 12 to move down a short distance, which in turn causes roller 130 to travel a small portion of the first half of its circular path 134. When the user stops to apply force on housing 12, roller 130 will automatically be balanced at the instant position, and housing 12 will automatically move back upwardly. Then the user can apply a downward force on housing 12 again and repeat the process until roller 130 completes the first half of its circular path 134. Of course for a strong user the whole action can be completed at once.

Referring to FIG. 8, there is shown another partial cross-sectional side view of the present invention semi-automatic mop wringer 10, showing wringer roller 130 at a return position in the second half of its circular path 134. The second half of the circular path 134 is circumscribed by a semi-circular shaped sidewall 170 of main compartment 20. Semi-circular shaped wringer plate 90 and semi-circular shaped sidewall 170 join at their lower ends where a slit 172 may be provided for draining excessive water.

When roller 130 moves in the second half of its circular path 134, large ratchet wheel 154 has rotated to a position where spring 160 is no longer resisting its rotation in the C+ direction, but instead applying a torque in the C+ direction which drives large ratchet wheel 154 to rotate in the C+ direction. The rotation of large ratchet wheel 154 in the C+ direction then causes spur gear 150 to keep rotating in the C− direction, which in turn drives roller 130 to complete the second half of its circular path 134.

It is an additional unique feature of the present invention mop wringer 10 that roller 130 automatically returns back to its starting position. When roller 130 moves in the second half of its circular path 134, spur gear 150 keeps rotating in the C− direction. However, since spur gear 150 is only engaged with pinion wheel 142 in a one-way manner through pawl 146 and small ratchet wheel 148, the rotation of spur gear 150 in the C− direction will not disturb pinion wheel 142. This means that when roller 130 moves in the second half of its circular path 134, spur gear 150 will not be subjected to any resistance from pinion wheel 142, which could be great because of the weight of housing 12. In fact, pawl 146 and ratchet 148 form a one-way mechanism which isolates pinion 142 and spur gear 150, either when housing 12 moves upwardly or when roller 130 moves in the second half of its circular path 134. In other words, the upward movement of housing 12 and the return movement of roller 130 can happen independently or even simultaneously.

It is noted that only the wringing mechanism located in the side compartment 60 is shown in the drawings. The wringing mechanism in the side compartment 50 is identical and symmetric to that shown in FIGS. 6 through 8.

Figure 9:
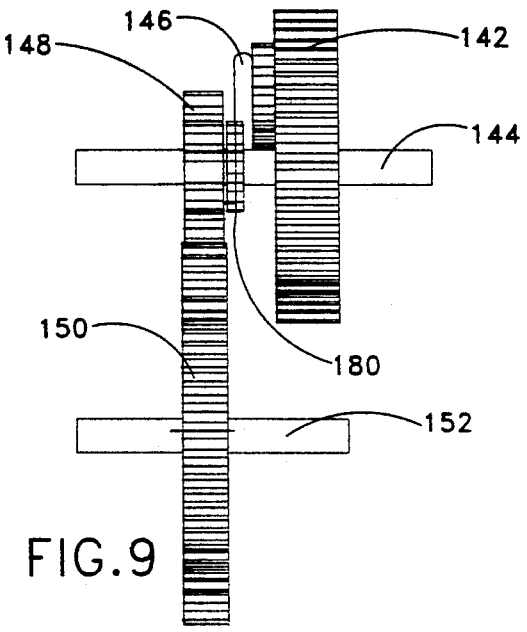
FIG. 9 is an end view showing a detailed arrangement of the one-way ratchet-wheel mechanism between the pinion wheel and the spur gear of the present invention semi-automatic mop wringer.

Referring to FIG. 9, there is shown an end view showing a detailed arrangement of the one-way ratchet-wheel mechanism between pinion wheel 142 and spur gear 150 of the present invention semi-automatic mop wringer 10. A small spur gear 180 may be coupled with small ratchet wheel 148 and engaged with pawl 146 for providing a fine transition with desired gear ratio.

Figure 10:
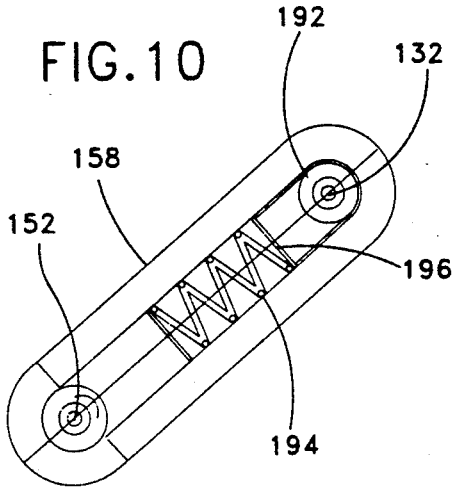
FIG. 10 is a perspective view of one of the wringer crank of the present invention semi-automatic mop wringer.

Referring to FIG. 10, there is shown a perspective view of crank 158 of the present invention semi-automatic mop wringer 10. Roller axle 132 is mounted to a slidable bearing 192 which is biased by a coil spring 194. This arrangement provides a mechanism to automatically adjust the tension applied by roller 130 to mop 2. A screw 196 may be further provided for fine tuning the spring force. Crank 128 has a similar construction as crank 158. Since the slidable bearing 192 can move radially inwardly, the wringer roller 130 can overcome the stopping pin 136 upon the initial impact applied to the wringer housing 12 and starts the first half of the circular path 134.

Figure 11:
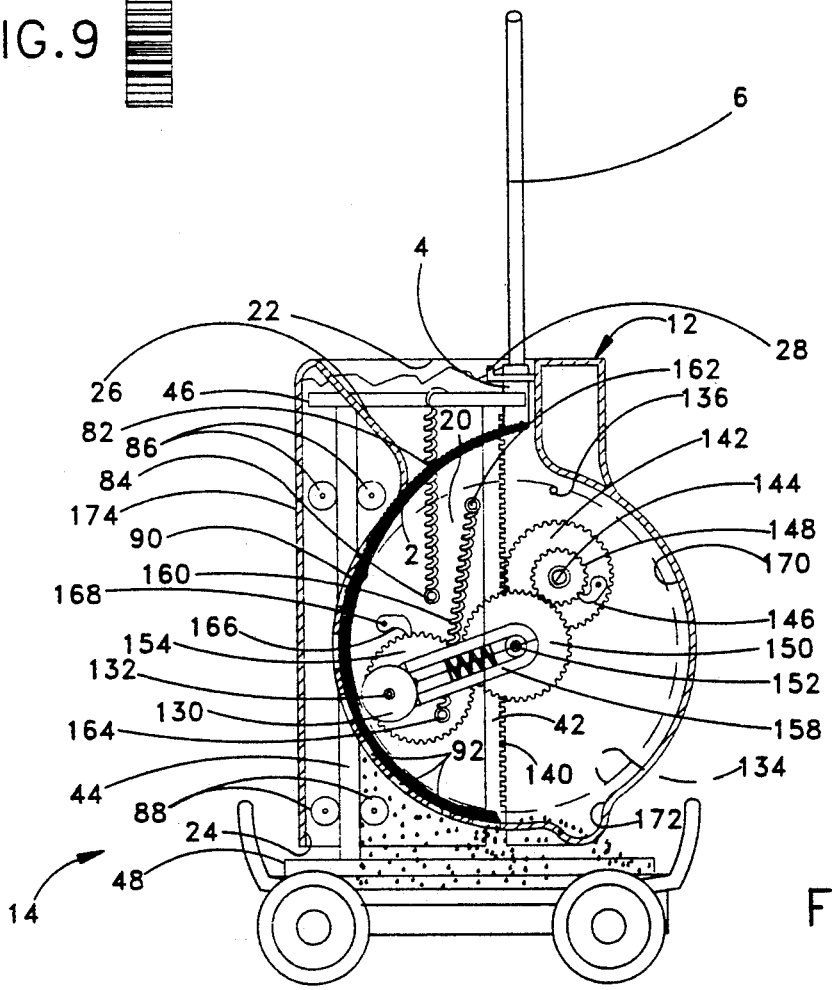
FIG. 11 is a partial cross-sectional side view showing the present invention semi-automatic mop wringer is being used to wring a mop.

Referring to FIG. 11, there is shown a partial cross-sectional side view showing the present invention semi-automatic mop wringer 10 being used to wring mop 2. When mop 2 is placed into main compartment 10, mop holder 4 is attached to hooks 28 and mop handle 6 is generally vertically oriented. When roller 130 moves in the first half of its circular path 134, it squeezes mop 2 against wringer plate 90. The distance between roller 130 and wringer plate 90 is designed to be adaptable to most conventional mops. The special features of cranks 128 and 158 allow certain flexibility in the distance between roller 130 and wringer plate 90, and automatically adjust the force applied to mop 2 by roller 130.

It is a further unique feature of the present invention mop wringer 10 that mop 2 is squeezed from top to bottom which best facilitates water to flow down, whereas in prior art mop wringers the whole mop is squeezed between two flat plates at once. The water can flow through the multiplicity of apertures 92 and may be collected by water basket 8. Excessive water can flow through bottom slit 172 of housing 12. In addition, the present invention spreads the mop allowing a maximum area to be exposed. This allows the roller to create line contact with a greater surface area of the mop and apply greater force to the mop. As the mop rotates through its circle, the wringer contacts all of the exposed area of the mop. In contrast, prior mop wringers pile the mop in a limited available space and apply force on the entire area at once. This results in distribution of force on a localized area which is like dividing the input force by area. Much less of the mop is wrung dry.

In one preferred embodiment, the pinion wheels 112 and 142, the spur gears 120 and 150, and the large ratchet wheels 124 and 154 all have identical diameters. Therefore, the tangential force applied on the mop 2 by wringer roller 130 is approximately equal to the downward force applied to the housing 12 by the user.

Defined in detail, the present invention is a semi-automatic mop wringer for wringing a mop that is attached to a mop handle through a mop holder, the mop wringer comprising: (a) a housing having a main central compartment, a first side compartment and an opposite second side compartment, the main compartment being a wide hollow through compartment with an upper entrance and a lower outlet, the first and second side compartments being narrow hollow compartments with respective lower openings; (b) a supporting structure having a first vertical stand and an opposite second vertical stand each including a rack, the first and second vertical stands extending into said first and second side compartments through their said lower openings respectively; (c) said housing being suspended upon said supporting structure by spring suspension means and being able to move up and down; (d) a first pinion wheel and a symmetric second pinion wheel rotatably mounted in said first and second side compartments respectively and engaged with said rack of said first and second stands respectively, the downward movement of said housing causing said first and second pinion wheel to rotate in a first direction and the upward movement of said housing causing said first and second pinion wheel to rotate in an opposite second direction; (e) a first spur gear and a symmetric second spur gear rotatably mounted in said first and second side compartments respectively and coupled with a pair of symmetric cranks respectively which supports a wringer roller, the rotation of the first and second spur gears causing the roller to move in a circular path which includes a first half and a second half; (f) a first pawl-ratchet mechanism for transmitting in one way the rotation of said first and second pinion wheels to said first and second spur gears respectively, the first pawl-ratchet mechanism including a first moving pawl and a second moving pawl mounted on said first and second pinion wheels respectively, and a first small ratchet wheel and a symmetric second small ratchet wheel rotatably mounted in said first and second side compartments respectively, engaged with the first and second moving ratchet respectively and meshed with said first and second spur gears respectively, such that the rotation of said first and second pinion wheels in said first direction causes said first and second spur gears to rotate in said second direction, but the rotation of said first and second said pinion wheels in said second direction does not cause said first and second spur gears to rotate; (g) a second pawl-ratchet mechanism for regulating the rotation of said first and second spur gears respectively, the second pawl-ratchet mechanism including a first stationary pawl and a second stationary pawl mounted to said housing and located in said first and second pinion wheels respectively, and a first large ratchet wheel and a symmetric second large ratchet wheel rotatably mounted in said first and second side compartments respectively and meshed with said first and second spur gears respectively, such that the first and second large ratchet wheels can only rotate one-way in said first direction, which prevents respectively said first and second spur gears from rotating in said first direction; (h) said first and second large ratchet wheels being biased by spring biasing means for balancing said first and said second spur gears to allow said wringer roller to move intermittently as it moves in said first half of said circular path, and for driving said first and second spur gears to rotate in said second direction as said wringer roller moves into said second half of said circular path, which causes said wringer roller automatically to complete said second half of said circular path; (i) a semi-circular wringer plate mounted in said main compartment for adapting said mop, the wringer plate circumscribing said first half of said circular path of said wringer roller and having a multiplicity of apertures for draining water; and (j) attaching means located proximal to said entrance of said main compartment for adapting said mop holder; (j) whereby a user can use said mop wringer to wring said mop by placing said mop into said main compartment, attaching said mop holder to said attaching means, holding said mop holder and applying a downward force, the downward movement of said housing will cause said wringer roller to move in said first half of said circular path and squeeze said mop against said wringer plate, when the user withdraws the downward force, said housing will move back upwardly to allow the user to repeat the process, and when said wringer roller completes said first half of said circular path and moves into said second half of said circular path, said wringer roller automatically completes said second half of said circular path.

Defined broadly, the present invention is a semi-automatic mop wringer for wringing a mop that is attached to a mop handle through a mop holder, the mop wringer comprising: (a) a housing vertically movably supported on a supporting structure by suspension means, the housing having a hollow compartment with a top entrance and a bottom outlet, the supporting structure including a vertical rack meansl (b) means located adjacent to said entrance of said compartment for attaching said mop holder when said mop is placed inside said compartment; (c) a curved wringer plate mounted in said compartment for adapting said mop and having a multiplicity of apertures for draining water; (d) a wringer roller driven by crank means and movable in a circular path, along a portion of the circular path the wringer roller squeezing said mop against said wringer plate; (e) a pinion wheel engaged with said vertical rack means for transmitting the vertical motion of said housing into the rotation of the pinion wheel; (f) gear means for transmitting the rotation of said pinion wheel to said crank means, the gear means including a ratchet mechanism for transmitting one-way rotation, such that the upward movement of said housing will not cause said crank means to rotate; and (g) spring biased ratchet means for restricting the rotation of said crank means to only one direction and causing said crank means automatically to drive said wringer roller to complete said circular path after said wringer roller has completed said squeezing portion; (h) whereby a user can use said mop wringer to wring said mop by placing said mop into said compartment, attaching said mop holder to said attaching means, holding said mop holder and applying a downward force, the downward movement of said housing will cause said wringer roller to move in said squeezing portion of said circular path and squeeze said mop against said wringer plate, when the user withdraws the downward force, said housing will move back upwardly to allow the user to repeat the process, and when said wringer roller has completed said squeezing portion of said circular path, said wringer roller automatically completes the circle of said circular path.

Defined more broadly, the present invention is a semi-automatic mop wringer for wringing a mop that is attached to a mop handle through a mop holder, the mop wringer comprising: (a) a housing vertically movably supported on a supporting structure by suspension means, the housing having a hollow compartment with a top entrance and a bottom outlet, the supporting structure including a vertical rack means; (b) means located adjacent to said entrance of said compartment for attaching said mop holder when said mop is placed inside said compartment; (c) a curved wringer plate mounted in said compartment for adapting said mop and having a multiplicity of apertures for draining water; (d) a wringer roller driven by crank means and movable in a circular path, along a portion of the circular path the wringer roller squeezing said mop against said wringer plate; (e) a pinion wheel engaged with said vertical rack means for transmitting the vertical motion of said housing into the rotation of the pinion wheel; and (f) gear means for transmitting the rotation of said pinion wheel to said crank means, the gear means including a ratchet mechanism for transmitting one-way rotation, such that the upward movement of said housing will not cause said crank means to rotate; (g) whereby a user can use said mop wringer to wring said mop by placing said mop into said compartment, attaching said mop holder to said attaching means, holding said mop holder and applying a downward force, the downward movement of said housing will cause said wringer roller to move in said squeezing portion of said circular path and squeeze said mop against said wringer plate, and when the user withdraws the downward force, said housing will move back upwardly to allow the user to repeat the process.

Defined even more broadly, the present invention is a semi-automatic mop wringer for wringing a mop that is attached to a mop handle through a mop holder, the mop wringer comprising: (a) housing vertically movably supported on a supporting by suspension means, the housing having a hollow compartment with a top entrance and a bottom outlet; (b) a curved wringer plate mounted in said compartment for adapting said mop and having a multiplicity of apertures for draining water; (c) a wringer roller driven by crank means and movable in a circular path, along a portion of the circular path the wringer roller squeezing said mop against said wringer plate; and (d) a rack-and-gear mechanism for transmitting a downward motion of said housing to said crank means; (e) whereby a user can use said mop wringer to wring said mop by placing said mop into said compartment, holding said mop holder and applying a downward force, the downward movement of said housing will cause said wringer roller to move in said squeezing portion of said circular path and squeeze said mop against said wringer plate, and when the user withdraws the downward force, said housing will move back upwardly to allow the user to repeat the process.

Defined most broadly, the present invention is a semi-automatic mop wringer for wringing a mop that is attached to a mop handle through a mop holder, the mop wringer comprising a hollow housing vertically movably supported on a supporting structure by suspension means, the housing engaged with the supporting structure through a rack-and-gear mechanism for transmitting a downward motion of the housing to rotation of a crank means, which in turn drives a wringer roller to squeeze the mop against a wringer plate mounted inside the housing.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A semi-automatic mop wringer for wringing a mop that is attached to a mop handle through a mop holder, the mop wringer comprising:

a. a housing having a main central compartment, a first side compartment and an opposite second side compartment, the main compartment being a wide hollow through compartment with an upper entrance and a lower outlet, the first and second side compartments being narrow hollow compartments with respective lower openings;

b. a supporting structure having a first vertical stand and an opposite second vertical stand each including a rack with teeth, the first and second vertical stands extending into said first and second side compartments through their said lower openings respectively;

c. said housing being suspended upon said supporting structure by spring suspension means and being able to move up and down;

d. a first pinion wheel and a symmetric second pinion wheel rotatably mounted in said first and second side compartments respectively and engaged with said teeth of said rack of said first and second stands respectively, the downward movement of said housing causing said first and second pinion wheel to rotate in a first direction and the upward movement of said housing causing said first and second pinion wheel to rotate in an opposite second direction;

e. a first spur gear and a symmetric second spur gear rotatably mounted in said first and second side compartments respectively and rotatably coupled with a pair of symmetric cranks, respectively, which support a wringer roller, the rotation of the first and second spur gears causing the roller to move in a circular path which includes a first half and a second half;

f. a first pawl-ratchet mechanism for transmitting in one-way the rotation of said first and second pinion wheels to said first and second spur gears respectively, the first pawl-ratchet mechanism including a first moving pawl and a second moving pawl mounted on said first and second pinion wheels respectively, and a first small ratchet wheel and a symmetric second small ratchet wheel rotatably mounted in said first and second side compartments respectively, engaged with the first and second moving ratchet respectively and meshed with said first and second spur gears respectively, such that the rotation of said first and second pinion wheels in said first direction causes said first and second spur gears to rotate in said second direction, but the rotation of said first and second said pinion wheels in said second direction does not cause said first and second spur gears to rotate;

g. a second pawl-ratchet mechanism for regulating the rotation of said first and second spur gears respectively, the second pawl-ratchet mechanism including a first stationary pawl and a second stationary pawl mounted to said housing and located in said first and second pinion wheels respectively, and a first large ratchet wheel and a symmetric second large ratchet wheel rotatably mounted in said first and second side compartments respectively and meshed with said first and second spur gears respectively, such that the first and second large ratchet wheels can only rotate one-way in said first direction, which prevents respectively said first and second spur gears to rotate in said first direction;

h. said first and second large ratchet wheels being biased by spring biasing means for balancing said first and said second spur gears to allow said wringer roller to move intermittently as it moves in said first half of said circular path, and for driving said first and second spur gears to rotate in said second direction as said wringer roller moves into said second half of said circular path, which causes said wringer roller automatically to complete said second half of said circular path;

i. a semi-circular wringer plate mounted in said main compartment for receiving said mop, the wringer plate circumscribing said first half of said circular path of said wringer roller and having a multiplicity of apertures for draining water; and j. receiving and supporting means located proximal to said entrance of said main compartment for receiving and supporting said mop holder;

k. whereby a user can use said mop wringer to wring said mop by placing said mop into said main compartment, placing said mop holder onto said receiving and supporting means, holding said mop handle and applying a downward force to said mop handle, the downward movement of said housing causing said wringer roller to move in said first half of said circular path and squeeze said mop against said wringer plate, when the user withdraws the downward force, said housing will move back upwardly to allow the user to repeat the process, and when said wringer roller completes said first half of said circular path and moves into said second half of said circular path, said wringer roller automatically completes said second half of said circular path.

2. The invention as defined in claim 1 wherein said first and second stands each further includes an upper horizontal beam supported by said respective rack and a vertical rail, where said rack and the rail are coupled by a lower base.

3. The invention as defined in claim 1 wherein said spring suspension means includes a first coil spring located in said first side compartment and a second coil spring located in said second side compartment.

4. The invention as defined in claim 1 wherein said first and second cranks each includes a spring biased slidable bearing for flexibly supporting said roller with adjustable tension.

5. The invention as defined in claim 1 wherein said receiving and supporting means located proximal to said entrance of said main compartment for receiving and supporting said mop holder includes a pair of spaced apart hooks.

6. A semi-automatic mop wringer for wringing a mop that is attached to a mop handle through a mop holder, the mop wringer comprising:

a. a housing vertically movably supported on a supporting structure by suspension means, the housing having a hollow compartment with a top entrance and a bottom outlet, the supporting structure including a vertical rack means which has a vertical rack with teeth;

b. means located adjacent to said entrance of said compartment for receiving and supporting said mop holder when said mop is placed inside said compartment;

c. a curved wringer plate mounted in said compartment for receiving said mop and having a multiplicity of apertures for draining water;

d. a wringer roller driven by crank means which has a rotatable crank and movable in a circular path, along a portion of the circular path the wringer roller squeezing said mop against said wringer plate;

e. a pinion wheel engaged with said teeth of said vertical rack means for transmitting the vertical motion of said housing into the rotation of the pinion wheel;

f. gear means for transmitting the rotation of said pinion wheel to said rotatable crank of said crank means, the gear means including a ratchet mechanism for transmitting one-way rotation, such that the upward movement of said housing will not cause said crank of said crank means to rotate; and g. spring biased ratchet means for restricting the rotation of said crank of said crank means to only one direction and causing said crank means automatically to drive said wringer roller to complete said circular path after said wringer roller has completed said squeezing portion;

h. whereby a user can use said mop wringer to wring said mop by placing said mop into said compartment, placing said mop holder onto said receiving and supporting means, holding said mop handle and applying a downward force to said mop handle, the downward movement of said housing causing said wringer roller to move in said squeezing portion of said circular path and squeeze said mop against said wringer plate, when the user withdraws the downward force, said housing will move back upwardly to allow the user to repeat the process, and when said wringer roller has completed said squeezing portion of said circular path, said wringer roller automatically completes the circle of said circular path.

7. The invention as defined in claim 6 wherein said housing further comprises a side compartment for housing said supporting structure and said gear means.

8. The invention as defined in claim 6 wherein said means located adjacent to said entrance of said compartment for receiving and supporting said mop holder includes hook members.

9. The invention as defined in claim 6 wherein said gear means for transmitting the rotation of said pinion wheel to said rotatable crank of said crank means further includes a spur gear rotatably coupled with said rotatable crank of said crank means and engaged with said pinion wheel.

10. The invention as defined in claim 9 wherein said ratchet mechanism for transmitting one-way rotation includes a first ratchet wheel meshed with said spur gear and a movable pawl attached to said pinion wheel engaged with the first ratchet wheel.

11. The invention as defined in claim 9 wherein said spring biased ratchet wheel means includes a second ratchet wheel meshed with said spur gear and biased by a spring, and a stationary pawl mounted to said housing and engaged with the second ratchet wheel; where the spring acts to balance said rotation of said crank of said means when said wringer roller moves in said squeezing portion of said circular path, and acts to drive said crank means when said wringer roller has completed said squeezing portion of said circular path.

12. A semi-automatic mop wringer for wringing a mop that is attached to a mop handle through a mop holder, the mop wringer comprising:

a. a housing vertically movably supported on a supporting structure by suspension means, the housing having a hollow compartment with a top entrance and a bottom outlet, the supporting structure including a vertical rack means which has a vertical rack with teeth;

b. means located adjacent to said entrance of said compartment for receiving and supporting said mop holder when said mop is placed inside said compartment;

c. a curved wringer plate mounted in said compartment for receiving said mop and having a multiplicity of apertures for draining water;

d. a wringer roller driven by crank means which has a rotatable crank and movable in a circular path, along a portion of the circular path the wringer roller squeezing said mop against said wringer plate;

e. a pinion wheel engaged with said teeth of said vertical rack means for transmitting the vertical motion of said housing into the rotation of the pinion wheel; and f. gear means for transmitting the rotation of said pinion wheel to said rotatable crank of said crank means, the gear means including a ratchet mechanism for transmitting one-way rotation, such that the upward movement of said housing will not cause said crank of said crank means to rotate;

g. whereby a user can use said mop wringer to wring said mop by placing said mop into said compartment, placing said mop holder to said receiving and supporting means, holding said mop handle and applying a downward force to said mop handle, the downward movement of said housing causing said wringer roller to move in said squeezing portion of said circular path and squeeze said mop against said wringer plate, and when the user withdraws the downward force, said housing will move back upwardly to allow the user to repeat the process.

13. The invention as defined in claim 12 wherein said gear means for transmitting the rotation of said pinion wheel to said rotatable crank of said crank means further includes a spur gear rotatably coupled with said crank of said crank means and engaged with said pinion wheel.

14. The invention as defined in claim 13 wherein said ratchet mechanism for transmitting one-way rotation includes a first ratchet wheel meshed with said spur gear and a movable pawl attached to said pinion wheel engaged with the first ratchet wheel.

15. The invention as defined in claim 13 further comprising spring biased ratchet means engageable with said spur gear for restricting the rotation of said crank of said crank means to only one direction and causing said crank means automatically to drive said wringer roller to complete said circular path after said wringer roller has completed said squeezing portion.

16. The invention as defined in claim 15 wherein said spring biased ratchet wheel means includes a second ratchet wheel meshed with said spur gear and biased by a spring, and a stationary pawl mounted to said housing and engaged with the second ratchet wheel, where the spring acts to balance said rotation of said crank of said crank means when said wringer roller moves in said squeezing portion of said circular path, and acts to drive said crank means when said wringer roller has completed said squeezing portion of said circular path.

17. A semi-automatic mop wringer for wringing a mop that is attached to a mop handle through a mop holder, the mop wringer comprising:

a. a housing vertically movably supported on a supporting structure by suspension means, the housing having a hollow compartment with a top entrance and a bottom outlet, the supporting structure including a vertical rack means which has a vertical rack with teeth;

b. a curved wringer plate mounted in said compartment for receiving said mop and having a multiplicity of apertures for draining water;

c. a wringer roller driven by crank means which has a rotatable crank and movable in a circular path, along a portion of the circular path the wringer roller squeezing said mop against said wringer plate; and d. gear means engaged with said teeth of said vertical rack means for transmitting a downward motion of said housing into the rotation of said rotatable crank of said crank means;

e. whereby a user can use said mop wringer to wring said mop by placing said mop into said compartment, holding said mop handle and applying a downward force to said mop handle, the downward movement of said housing causing said wringer roller to move in said squeezing portion of said circular path and squeeze said mop against said wringer plate, and when the user withdraws the downward force, said housing will move back upwardly to allow the user to repeat the process.

18. The invention as defined in claim 17 wherein said gear means includes a pinion wheel engaged with said teeth of said vertical rack means.

19. The invention as defined in claim 18 wherein said gear means also includes a spur gear rotatably coupled with said rotatable crank of said crank means and engaged with said pinion wheel.

20. The invention as defined in claim 19 wherein said gear means further includes a ratchet mechanism for interconnecting said pinion wheel said spur gear in a one-way manner such that the upward movement of said housing will not cause said crank of said crank means to rotate.

21. The invention as defined in claim 19 further comprising spring biased ratchet mechanism engageable with said spur gear for restricting the rotation of said crank of said crank means to only one direction and causing said crank means automatically to drive said wringer roller to complete said circular path after said wringer roller has completed said squeezing portion.

22. The invention as defined in claim 21 wherein said spring biased ratchet mechanism includes a one-way ratchet wheel meshed with said spur gear and biased by a spring, where the spring acts to balance said rotation of said crank of said crank means when said wringer roller moves in said squeezing portion of said circular path, and acts to drive said crank means when said wringer roller has completed said squeezing portion of said circular path.

23. The invention as defined in claim 17 further comprising means for receiving and supporting said mop holder at a location adjacent to said entrance of said compartment.

24. A semi-automatic mop wringer for wringing a mop that is attached to a mop handle through a mop holder, the mop wringer comprising:

a. a housing vertically movably supported on a supporting structure by suspension means, the housing having a hollow compartment with a top entrance and a bottom outlet;

b. a curved wringer plate mounted in said compartment for receiving said mop and having a multiplicity of apertures for draining water;

c. a wringer roller driven by crank means which has a rotatable crank and movable in a circular path, along a portion of the circular path the wringer roller squeezing said mop against said wringer plate; and d. a rack-and-gear mechanism for transmitting a downward motion of said housing to said rotatable crack of said crack means;

e. whereby a user can use said mop wringer to wring said mop by placing said mop into said compartment, holding said mop handle and applying a downward force to said mop handle, the downward movement of said housing causing said wringer roller to move said squeezing portion of said circular path and squeeze said mop against said wringer plate, and when the user withdraws the downward force, said housing will move back upwardly to allow the user to repeat the process.

25. The invention as defined in claim 24 further comprising means for receiving and supporting said mop holder at a location adjacent to said entrance of said compartment.

* * * * *